US009097021B1

(12) United States Patent
Williams et al.

(10) Patent No.: US 9,097,021 B1
(45) Date of Patent: Aug. 4, 2015

(54) WEATHER SHIELDING SYSTEM FOR SLATE AND TILE ROOFS

(71) Applicants: John M. Williams, Wells, VT (US); Robert B. Williams, Poultney, VT (US)

(72) Inventors: John M. Williams, Wells, VT (US); Robert B. Williams, Poultney, VT (US)

( * ) Notice: Subject to any disclaimer, the term of this patent is extended or adjusted under 35 U.S.C. 154(b) by 0 days.

(21) Appl. No.: 14/280,596

(22) Filed: May 17, 2014

(51) Int. Cl.

| | |
|---|---|
| ***E04D 1/36*** | (2006.01) |
| ***E04D 1/00*** | (2006.01) |
| ***E04D 5/06*** | (2006.01) |
| *E04D 1/34* | (2006.01) |

(52) U.S. Cl.
CPC *E04D 1/365* (2013.01); *E04D 1/00* (2013.01); *E04D 5/06* (2013.01); *E04D 2001/3411* (2013.01)

(58) Field of Classification Search
CPC ..... E04D 1/14; E04D 1/34; E04D 2001/3411; E04D 2001/3423; E04D 2001/3432; E04D 2001/3414; E04D 2001/3458; E04D 2001/3467; E04D 2001/3473; E04D 12/004; E04D 12/006; E04D 1/00; E04D 5/06; E04D 1/365
USPC ..... 52/543, 547–552, 478, 489.1, 489.2, 52/712, 58, 60
See application file for complete search history.

(56) References Cited

U.S. PATENT DOCUMENTS

| | | | | |
|---|---|---|---|---|
| 623,988 | A * | 5/1899 | Contant | 52/26 |
| 2,057,819 | A * | 10/1936 | Corcoran et al. | 52/395 |
| 2,495,303 | A * | 1/1950 | Wisniewski | 52/468 |
| 3,646,717 | A * | 3/1972 | Parker | 52/548 |
| 4,426,823 | A * | 1/1984 | Kobe | 52/748.1 |
| 5,457,924 | A | 10/1995 | Fujii et al. | |
| 5,471,807 | A * | 12/1995 | Vasquez | 52/553 |
| 5,533,313 | A * | 7/1996 | Pike et al. | 52/712 |
| 5,791,112 | A | 8/1998 | Plum | |
| 5,794,396 | A * | 8/1998 | Gibbs | 52/518 |
| 5,921,045 | A * | 7/1999 | Hickey et al. | 52/543 |
| 6,052,961 | A * | 4/2000 | Gibbs | 52/518 |
| 6,125,592 | A * | 10/2000 | Hickey et al. | 52/543 |
| 6,148,578 | A | 11/2000 | Nowacek et al. | |
| 6,155,006 | A * | 12/2000 | Mimura et al. | 52/173.3 |
| 6,470,642 | B1 * | 10/2002 | Eads | 52/518 |
| 6,516,572 | B1 | 2/2003 | Nowacek et al. | |
| 7,448,177 | B2 | 11/2008 | McClintick | |
| 7,454,873 | B2 | 11/2008 | McClintick | |
| 8,033,072 | B2 * | 10/2011 | McClintick | 52/551 |
| 8,215,070 | B2 * | 7/2012 | Railkar et al. | 52/173.3 |
| 8,661,760 | B2 * | 3/2014 | Williams et al. | 52/547 |
| 8,661,761 | B2 | 3/2014 | Williams | |
| 8,677,710 | B2 | 3/2014 | Williams et al. | |
| 2011/0067339 | A1 * | 3/2011 | Hall | 52/543 |
| 2012/0055111 | A1 * | 3/2012 | Fernandez Fernandez | 52/543 |
| 2012/0304578 | A1 * | 12/2012 | Williams | 52/520 |
| 2013/0125488 | A1 * | 5/2013 | Svec | 52/309.1 |

FOREIGN PATENT DOCUMENTS

WO WO 2012148453 A1 * 11/2012

* cited by examiner

*Primary Examiner* — Joshua J Michener
*Assistant Examiner* — Theodore Adamos
(74) *Attorney, Agent, or Firm* — Lawrence J. Shurupoff

(57) ABSTRACT

Lightweight tile roofs using a single overlap of tiles between adjacent tile courses are protected from wind, rain, snow, ice, humidity and sun with a base layer of water resistant weatherproofing material and with a series of waterproof or water resistant shield strips. The shield strips are laterally spaced apart so as to underlie the cracks, joints or channels formed between the adjacent side edges of each pair of juxtaposed tiles. This double layer of weatherproofing material extends the useful life of lightweight tile roofs.

7 Claims, 8 Drawing Sheets

WEATHER SHIELDING SYSTEM FOR SLATE AND TILE ROOFS

REFERENCE TO RELATED PATENTS

This application is related to U.S. Pat. Nos. 8,661,760; 8,661,761 and 8,677,710 each of which is incorporated herein by reference in its entirety.

BACKGROUND AND SUMMARY

The installation of slate and tile roofs is labor intensive and typically requires skilled workers to properly set down overlapping courses of relatively brittle roofing tiles. When used herein, "tiles" refers to natural tiles such as slate tiles as well as artificial tiles such as those fabricated from ceramic materials.

Recent developments in slate roof installation systems have simplified the installation of roofing tiles while also reducing the amount of tiles required to cover a roof. One such improved system requires only a single overlap of one upper course or row of tiles over the top or upper portion of a lower course of tiles. This system requires the use of a layer of water resistant material such as a thin sheet of plastic, "tar paper" or similar construction material to provide adequate protection for the underlying roof decking.

That is, instead of using three rows of overlapping tiles to waterproof an underlying roof deck, a layer of waterproof or water resistant sheet material is placed beneath each row of tiles so as to provide a water repelling layer beneath the adjacent side edges of adjoining tiles. The sheet material thereby prevents water seeping between the cracks or openings formed between adjacent tiles from damaging the underlying roof deck.

While this system is easier to install than conventional "three layer" tile roofs, the underlying layers of water resistant material can degrade over time due to embrittlement from sunlight as well as from abrasion from sand, dust and grit particles blown by high winds. Moreover, the lowest course or row of tiles in "two layer" systems can be subject to damage from high winds due to the lighter weight of a single overlying row of tiles.

That is, conventional three layer tile roofs apply the weight and stability of two overlying courses or rows of tiles to the lowest or bottom row or course of tiles to secure each respective bottom row of tiles in position. This is particularly advantageous along the lowest row or course of tiles located along eave portions of each roof where exposure to high winds tends to lift or peel the exposed tile edges upwardly, allowing for the entry of wind-blown rain. In extreme conditions such as in hurricanes, these eave tiles can be lifted upwardly and blown away.

This disclosure is directed to lightweight tile roofing systems which address the drawbacks noted above. In particular, in one embodiment, a tile roofing system is disclosed wherein a single overlap between two rows of tiles is strengthened along the lowest row of tiles adjacent the eave of a roof.

Moreover, the portion of a waterproofing layer of sheet material exposed between the cracks or openings formed between the sides of adjacent tiles is protected with an overlying strip of water resistant or waterproof material, such as high density polyethylene (HDPE).

DESCRIPTION OF REPRESENTATIVE EMBODIMENTS

Figure 1:
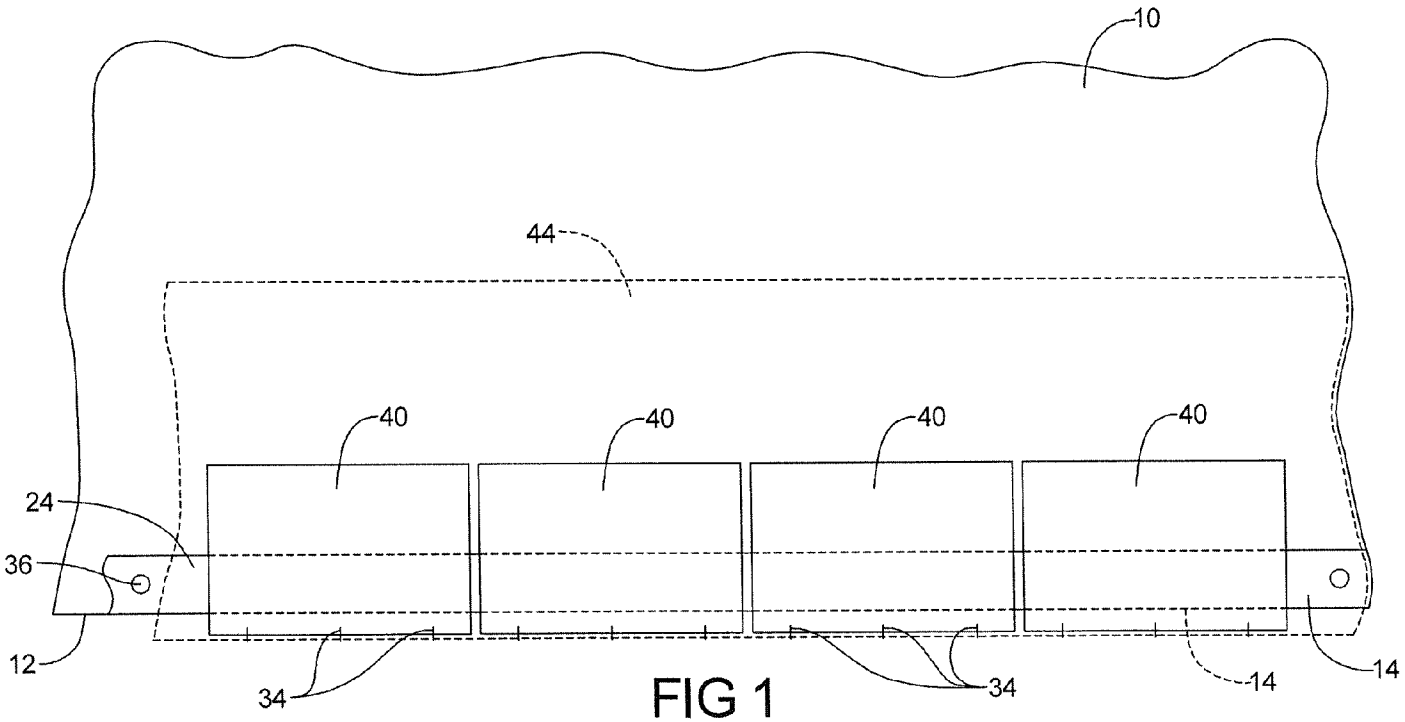
FIG. 1 is a partial top plan view of a first embodiment of this disclosure showing the installation of a drip edge assembly and a first or starter row of starter tiles.

As seen in FIG. 1, a pitched or sloping roof deck 10, typically constructed from plywood, particle board or similar building materials, includes a lower edge portion or eave 12 which typically extends over and outwardly from the outside walls of a building. To begin the installation of a robust yet lightweight tile roof, a drip edge assembly 14 is nailed or otherwise fastened over the bottom edge and lower portion of the eave 12.

Figure 2:
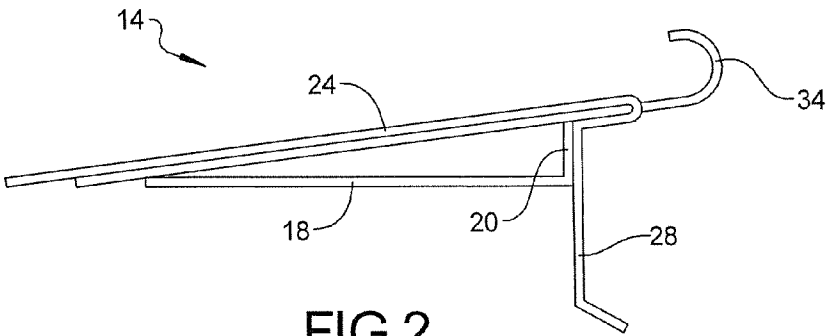
FIG. 2 is a side elevation view of the drip edge assembly of FIG. 1.

As seen in FIG. 2, the drip edge assembly 14, typically fabricated from weather resistant sheet material such as copper, stainless steel or other alloys, includes a base strip 18 which lies on the deck 10 along the eave 12. A lift arm 20 extends upwardly from the base strip 18 to provide a cant or elevation to the top strip 24. A front wall 28 extends downwardly from the top strip 24 to overlie the outer edge 32 of the eave 12, as seen in FIG. 3.

A wire hook 34 is fastened to the underside of the top strip 24 and projects outwardly from the bottom edge of the top strip for receiving and holding one or more tiles and a weather resistant sheet as described further below. As further seen in FIGS. 1 and 3, roofing nails 36 secure the drip edge assembly 14 in place over and against the eave 12. Once the drip edge assembly 14 is secured along the entire length of the eave 12, a row of starter tiles 40 (FIG. 1) is inserted into the wire hooks 34. The starter tiles 40 can be about the same side to side length of full tiles in the succeeding rows, but about half their bottom to top width, where the width is measured along the height or slope of the roof 10.

Figure 3:
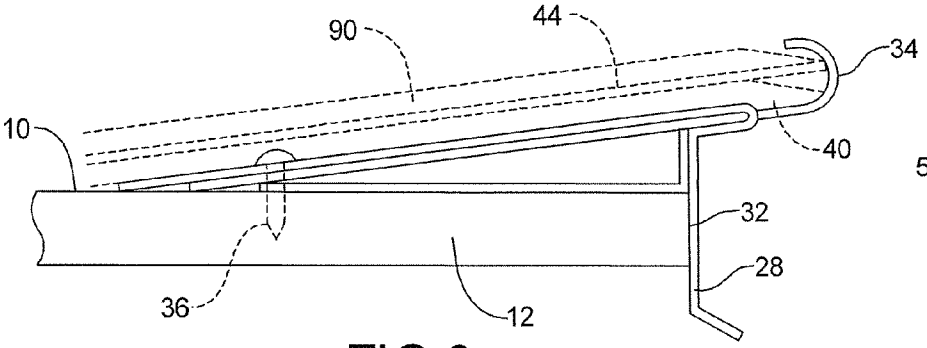
FIG. 3 is a partial side elevation view of the drip edge assembly of FIG. 1 installed on the eave of a roof deck and further showing the insertion of a starter tile as well as a full size roofing tile in the hook of the drip edge assembly of FIG. 1.

After inserting the starter tiles 40 in the hooks 34 as shown in FIGS. 1 and 3, a layer of roofing material 44 is inserted into the hooks 34 over the underlying starter tiles 40. In one example, the roofing material 44 can be a ceramic coated layer of 90# rolled roofing commonly used in the roofing trade and referred to as "tar paper." The width or height of the roofing material 44 should match the width or height of the tiles which will overlie the roofing material 44. For example, the width of the roofing material used with 12 inch by 10 inch slate tiles should be 12 inches wide (high), and with 10 inch by 8 inch slate tiles the width should be 10 inches wide (high).

Figure 4:
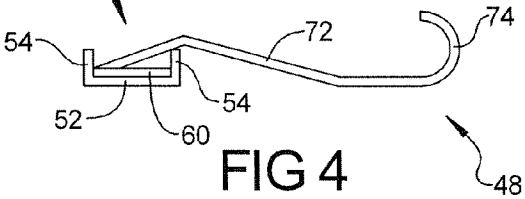
FIG. 4 is a side elevation view of an integral mounting strip and hook.
Figure 5:
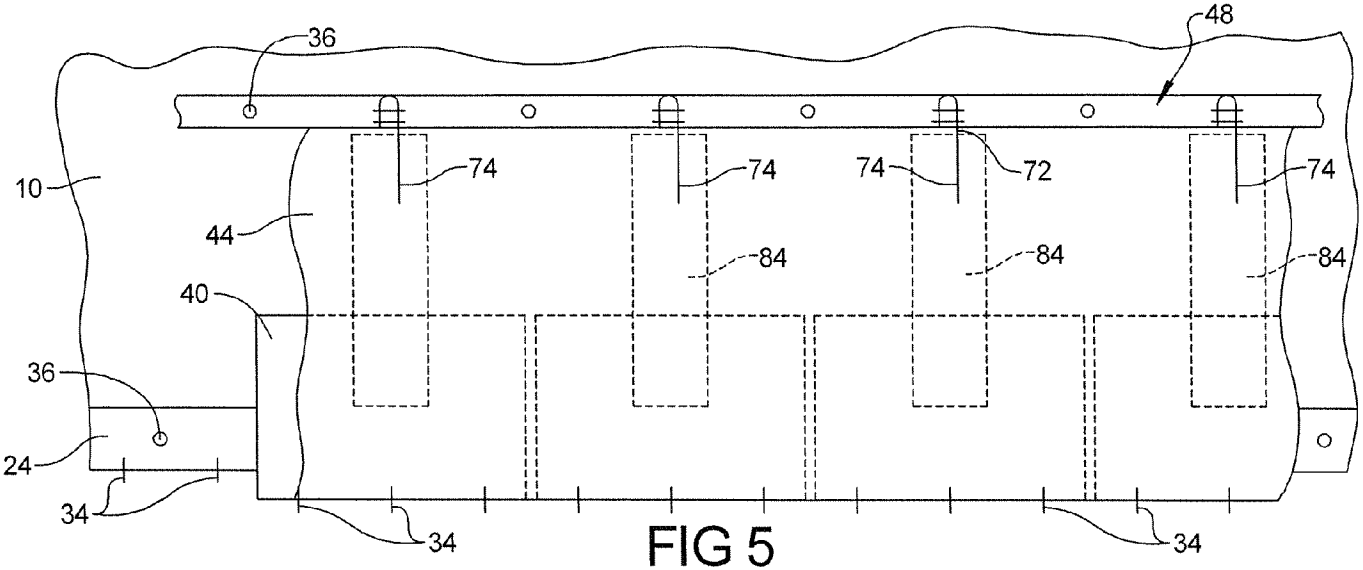
FIG. 5 is a top plan view of FIG. 1 with a layer of waterproof roofing material applied over the starter tiles and showing in phantom the positioning of shield strips on the hooks of a mounting strip.

Once the water resistant or waterproof roofing material 44 is installed in the hooks 34 and over the starter tiles 40, a mounting strip 48, as seen in FIGS. 4 and 5, is aligned over the upper edge of the roofing material 44 and fastened to the roof deck 10, such as with roofing nails 36. The mounting strip 48 includes a semi-rigid base portion 50 formed as a PVC plastic molding, extrusion or the like. The base portion 50 has a central channel or floor 52 bounded by a pair of upstanding lips 54. A tile fastener having a U-shaped mounting portion 60, as best seen in FIG. 6, is formed of a stiff wire, such as stainless steel wire, and attached to the base portion 50 with fasteners such as staples 56 (FIG. 6).

A tile fastener shank portion 72 extends outwardly and downwardly from the mounting portion 60, terminating in an open-mouthed hook 74. The shank portion 72 is shown in this first embodiment as a straight shank, but laterally-extending winged portions as described below can also be used. Added strength can be provided to the base portion 50 and to the shank portion 72 and hook portion 74 by nailing, for example, a one and one half inch stainless steel nail 80 over the looped or U-shaped mounting portion 60, as shown in FIG. 7.

Figure 6:
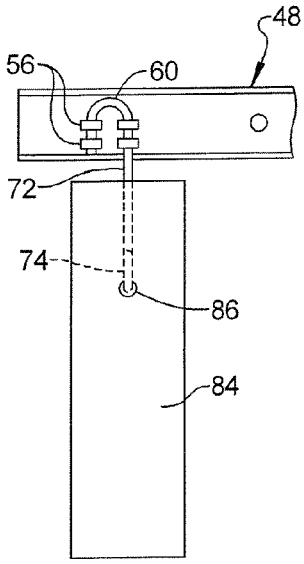
FIG. 6 is partial view of a shield strip positioned for attachment over a hook on the mounting strip.
Figure 7:
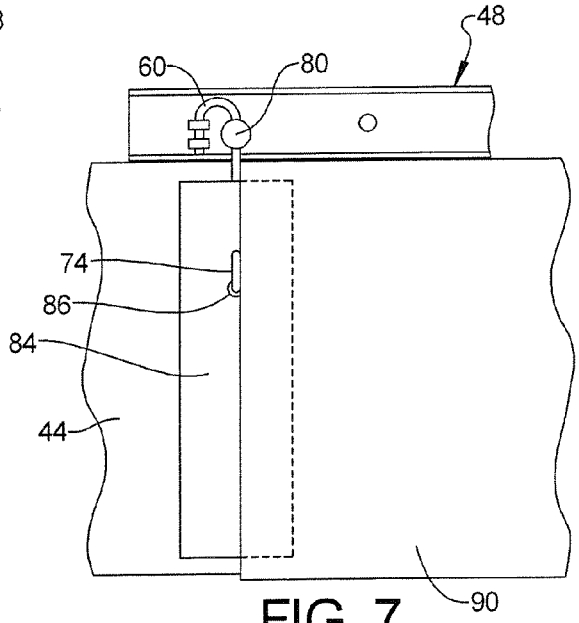
FIG. 7 is a partial view of a mounting strip aligned over the upper boarder of a layer of roofing material with a tile positioned over one side of a shield strip.
Figure 8:
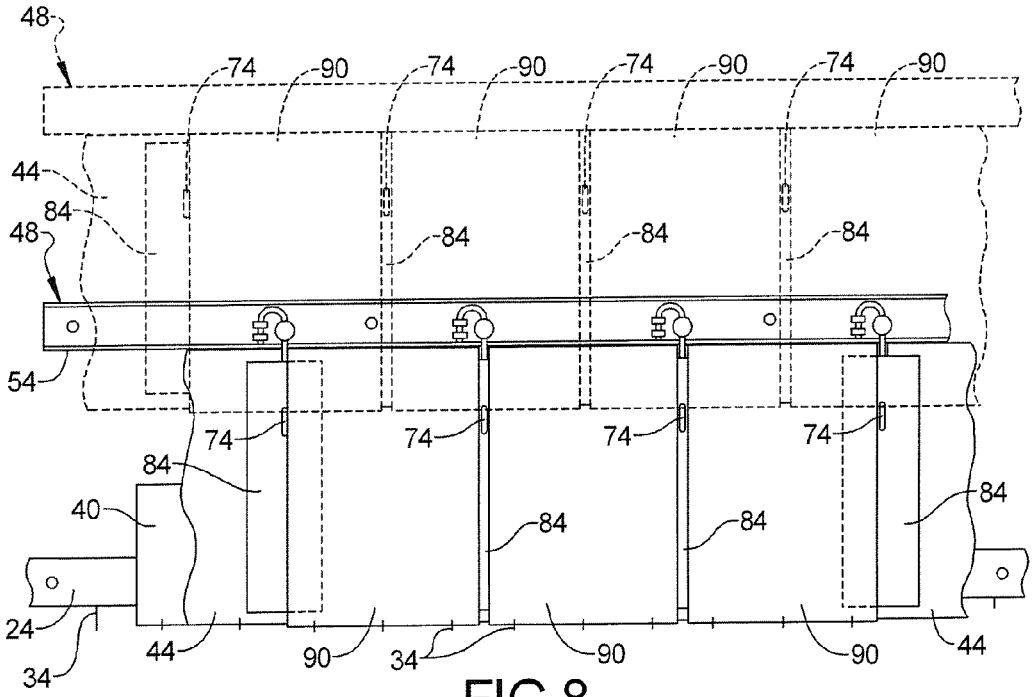
FIG. 8 depicts the installation of a first row of tiles between the hooks on the mounting assembly and overlying both the roofing material and the first course of starter tiles and showing in phantom the installation of the second or upper course of tiles and the provision of a second or upper mounting strip.

In order to provide additional protection for the roofing material 44 against degradation from prolonged exposure to outdoor environments, a shield strip 84 is positioned over each shank 72 and hook 74 as shown in phantom in FIG. 6, and attached to each hook 74 by threading as shown in FIGS. 7 and 8. A small hole 86, as shown in FIG. 6, is formed through the shield strip 84 through which the hook 74 is inserted with the shield strip 84 covering or overlying the shank portion 72.

The shield strips 84 can be formed of thin sheets of plastic such as HDPE, or thin strips of metal such as stainless steel, copper or other corrosion and/or water resistant metals. Each shield strip 84 can be about, for example, three inches from side to side with a height of about twelve inches from top to bottom and a thickness of about 0.020 inch. The height is about the same as the height of the overlying tiles. A wide range of thickness is possible, depending on the strip material, and the side to side strip lengths can vary depending on the particular application, including local weather conditions.

As shown in FIG. 8, and in phantom in FIG. 3, once the shield strips 84 are installed on the hooks 74 and positioned over the roofing material 44, a first row or course of tiles 90 is placed over the shield strips 84 and on top of the roofing material 44. Each tile 90 is aligned between an adjacent pair of hooks 74 on the mounting strip 48 and into the mouths of the hooks 34 on the drip edge assembly 14. With this placement, the upper edge of each tile 90 is closely spaced from or in abutting contact with the lower lip 54 of the mounting strip 48.

Once the first row or course of tiles 90 is installed along the eave 12, as described above, a second layer of roofing material 44 is rolled out along and over the first mounting strip 48 with the lower edge of the roofing material 44 inserted into the open mouths of the hooks 74 on the mounting strip 48. This is shown in phantom in FIG. 8. Again, the height of the roofing material 44 should approximate the height of the tiles 90.

At this point, a second mounting strip 48 is fastened to the roof deck 10 along and adjacent to the upper edge of the second course of roofing material 44 as further shown in phantom in FIG. 8. The hooks 74 on this second mounting strip 48 are symmetrically positioned laterally midway between each respective adjacent pair of hooks 74 on the lower mounting strip 48. Shield strips 84 are then attached to the hooks 74 on the second upper mounting strip 48 in the same fashion as described above.

A second row or course of slate tiles 90 is then positioned over the second course of roofing material 44 and over the second series of shield strips 84. Each tile 90 is symmetrically inserted into a respective hook 74 so that each hook 74 is located equidistant from the opposite side edges of each engaged upper tile 90. In addition, each tile 90 is located between an adjacent pair of hooks 74 on the second mounting strip 48.

This sequence of installation is repeated for as many additional courses or upper rows of tiles 90 as is required to cover the roof deck 10, until the ridge top of the roof deck 10 is covered with tiles 90 or with a conventional ridge cover. While this system of tile installation works well, a more efficient installation system has been developed which eliminates the mounting strips 48 and reduces and simplifies the assembly and installation steps of a tile roof.

Figure 9:
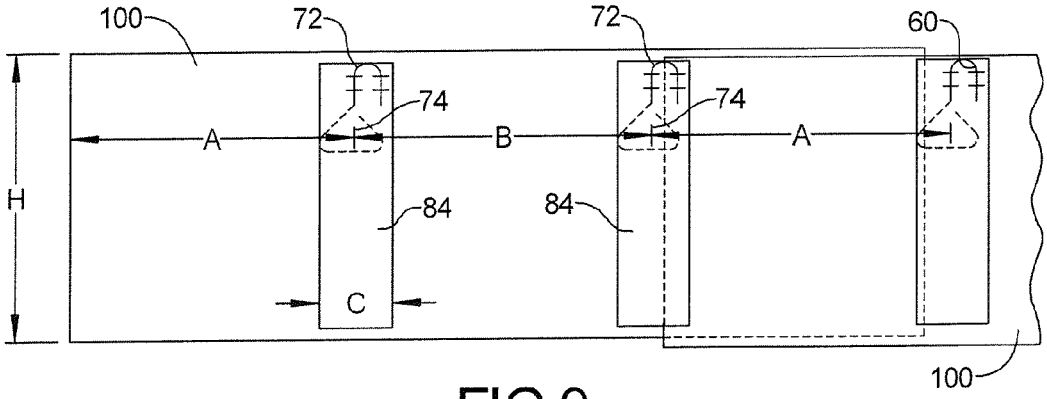
FIG. 9 is a top plan view of a second embodiment of this disclosure showing a partial strip of weather shield material provided with integral prefabricated shield strips.
Figure 10:
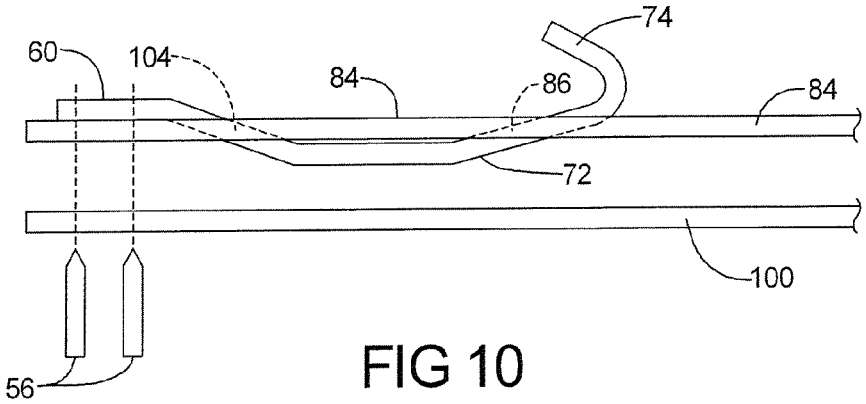
FIG. 10 is a partial exploded side view of the construction of the weather shield of FIG. 9.

As seen in FIG. 9, a first elongated rectangular weather shield 100 of water resistant or waterproof material such as high density polyethylene (HDPE) is provided with a series of shield strips 84 with integral tile fasteners provided with winged shanks 72 and hooks 74. The shanks 72 extend laterally below each side of the hooks. As seen in FIG. 10, a shield strip 84 is formed with an upper slit or slot 104 through which a hook 74 is inserted and moved underneath the shield strip and passed upwardly through a small hole 86. This subassembly is then fastened to the weather shield 100 with, for example, one or more staples 56, as further seen in FIG. 10. The thickness of the weather shield 100 can vary. For example, when constructed of HDPE, the thickness can be about 0.020 inch.

As further shown in FIG. 9, a weather shield 100 is dimensioned for use with, for example, twelve inch by twelve inch square tiles (12×12 slate). Dimension A, the distance from the first hook 74 to the left end or side edge for the weather shield 100 is approximately 11.75 inches, so as to provide an overlap with an adjacent weather shield 100 as described below. The shield strips 84 are fastened to the weather shield 100 at spaced intervals "B" of about 12.1875 inches. The height of the weather shield 100 is about equal to the height of the overlying tiles.

As the weather shields 100 can be provided in a roll in any suitable length from about three feet to fifteen or even twenty feet, up to a dozen or more shield strips 84 can be evenly spaced along a weather shield 100. In FIG. 9, only two shield strips 84 are provided on the first weather shield 100 for the purpose of illustration, with the distance A from the right end or side edge of the first weather shield to the second hook 74 being about 11.75 inches.

Three, six, ten or even twenty more evenly spaced shield strips 84 can be fixed to a single weather shield 100 and provided in the field as an integral scrolled compact roll which can be easily rolled out flat along a roof deck for installation. In the example of FIG. 9, the shield strips 84 can be dimensioned with a lateral or side to side dimension C of about three inches.

As further shown in FIG. 9, a second weather shield 100 can be aligned with the right side of the first weather shield 100 with the left side edge of the second weather shield 100 tucked under the second or adjoining shield strip 84 on the end of the first weather shield. The dimensioning of the weather shield 100 and shield strips 84 as described above facilitates the proper location and spacing of adjacent weather shields. An installer need only laterally overlap the edge of a second weather shield 100 onto and over an end portion of an adjacent weather shield 100 until a side edge of the second weather shield slides under the nearest shield strip 84, approximately up to abutment with a fastener 72.

This construction is shown in FIG. 9, with the second weather shield slightly misaligned in height with the first weather shield 100 for the purpose of clarity and illustration only. In the field there should be little or no such offset or misalignment in weather shield heights.

In order to install a tile roof using the weather shield 100 as a weatherproofing base layer, installation begins as described above with the installation of a drip edge assembly 14 along the eave 12 of a roof 10.

Figure 11:
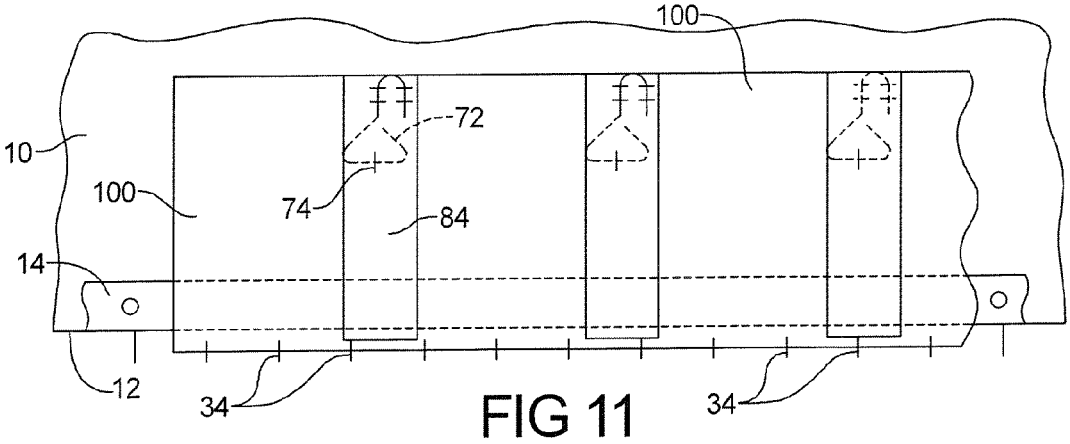
FIG. 11 is a partial top plan view of the weather shield of FIG. 9 installed in the hooks of a drip edge assembly along the eave of a roof deck.

As shown in FIG. 11, once the drip edge assembly 14 is installed, a weather shield 100 is positioned over the drip edge assembly 14 with the bottom edge of the weather shield 100 inserted into the drip edge hooks 34. If additional lengths of weather shields are required to cover the entire eave 12, they are overlapped and tucked under adjacent shield strips 84 as described above.

Figure 12:
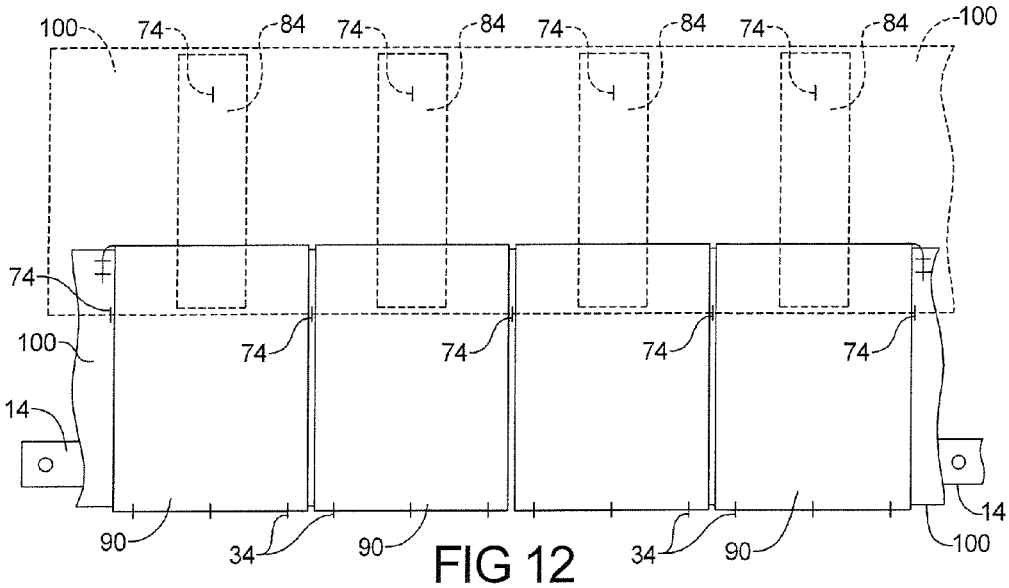
FIG. 12 is a top plan view of FIG. 11 showing in phantom the installation of a second or upper weather shield inserted into the hooks of the first underlying weather shield and showing the installation of a first row of tiles over the first weather shield.

The next step is to insert a first row of full size (e.g. 12"×12", 12"×10", 12"×8") tiles 90 over the weather shield 100 and into the hooks 34 on the drip edge 14. Each tile is located closely between a pair of adjacent hooks 74 on weather shield 100 as seen in FIG. 12. As further seen in phantom in FIG. 12, a second sheet of weather shield 100 is placed over the top portions of the first row of tiles 90 and inserted into the mouths of the hooks 74 on the bottom or first weather shield. The hooks 74 are dimensioned to project upwardly through the cracks or spaces between adjacent tiles 90 and above the outer surfaces of the tiles 90. The hooks 74 on the second or upper sheet of weather shield 100 are aligned over the center of each tile 90 in the first row, i.e. half way between the side edges of the first row of tiles 90.

The second sheet of weather shield 100 can extend, for example, over the top three inches of the underlying tiles 90. Notably, no separate roofing material 44 and shield strip 84 requires field assembly and the mounting strip 48 of the prior embodiment is completely eliminated. This simplifies and expedites the installation of the tiles 90.

Figure 13:
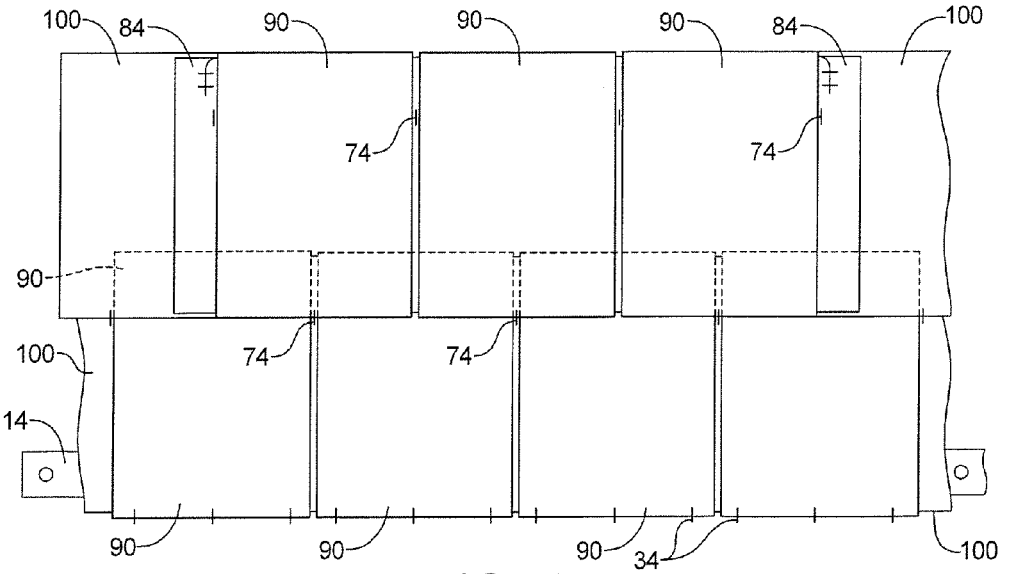
FIG. 13 is a view of FIG. 12 showing a second row of tiles installed over the second weather shield.

In a manner similar to that described above with respect to the previous or first embodiment, a second row or course of tiles 90 is inserted into the hooks 74 projecting upwardly above the first row of tiles 90 and between adjacent pairs of hooks 74 on the second or upper weather shield 100. This arrangement is shown in FIG. 13, where the second row of tiles overlaps the lower row of tiles by about, for example, three inches.

The next step is to lay down another or third sheet of weather shield 100 over the top portion of the second row of tiles 90 and into the hooks 74 on the second layer of weather shield 100. The hooks 74 on the third weather shield 100 are located over the centerline or middle of each underlying tile in the second row of tiles 90 in a staggered pattern so that the hooks 74 on a third sheet of weather shield 100 (not shown) are vertically aligned directly in line over the hooks 74 on the first sheet of weather shield 100.

The installation of tiles 90 then proceeds as described above until the tiles 90 reach the top of the roof deck 10. At this point, a conventional roof ridge is installed over the ridge of the roof.

While the two preceding embodiments provide for the convenient installation of tile roofs without the need for highly skilled roofers while reducing the time and cost involved in installing a tile roof as compared to conventional nailing, it is further desirable to provide for increased tile protection against high winds when installing a single overlap tile roof. That is, because the two prior embodiments use less tiles than heavier conventional "three layer" tiles roofs and thereby apply less overlying weight to each underlying tile, the two installation systems described above can be more susceptible to wind damage than conventionally installed tile roofs which use three overlapping layers of tiles.

Wind damage is particularly acute along the first row or course of tiles installed over the eave of a building where wind can more easily flow under the first row or course of tiles and cause damage such as erosion and potential loss of tiles blown away by the wind. A more wind resistant tile eave would decrease wind damage which most often occurs along the eaves of tile roofs.

Figure 14:
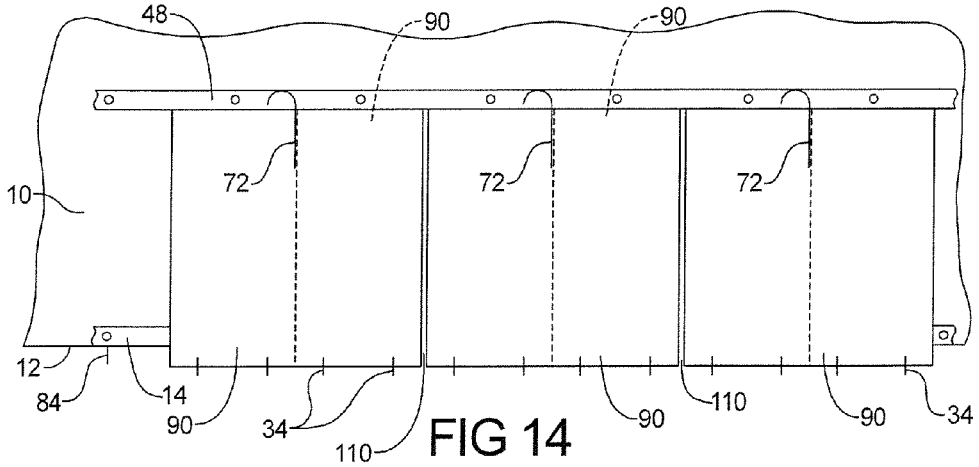
FIG. 14 is a top plan view of a third embodiment of this disclosure showing a first row of full size tiles installed within the hooks of a drip edge assembly and a mounting strip located along the top edges of the tiles.

The next embodiment addresses these problems by providing greater stability and overlying weight along the first course of tiles installed along the eave of a roof. As seen in FIG. 14, installation of this third embodiment begins as before with the installation of a drip edge assembly 14 along the eave 12 of a roof deck 10. Tiles 90, such as twelve inch by twelve inch slate tiles, are inserted into the hooks 34 on the drip edge 14 in a side by side series. When slate tiles are used, it is preferable to install this first row of tiles 90 "upside down," with the beveled edges facing downwardly toward the roof deck 10 for aesthetic purposes. That is, when slate tiles are trimmed to size, a cutting machine produces a chiseled edge or bevel along the borders of a slate tile. Positioning these beveled edges downward presents a more pleasing appearance.

Once the eave 12 is covered with the first course of, for example, 12×12 tiles, a mounting strip 48 is aligned over the top edges of these tiles in a close abutting relationship with hooks 74 centered over the top edges of the first layer of tiles 90 and then nailed or otherwise fastened to the roof deck 10.

At this point, a second layer of tiles 90 is layered in a staggered pattern, beveled side up, over the first layer of tiles 90 and between adjacent hooks 74 as shown in phantom in FIG. 14. This second layer of overlying tiles is also inserted into the hooks 34 on the drip edge assembly 14 with the side edge of this second layer of tiles aligned over the middle or center of the first layer of tiles. This provides two completely overlapping staggered layers of full size 12"×12" slate tiles 90 forming a first double tile row along eave 12 and thereby providing greater weight and resistance against the force of wind.

It should be emphasized that the hooks 74 on the mounting strip 48 are aligned over the middle or center line of each tile 90 in the first installed layer of tiles 90 and that the second layer of tiles 90 is positioned between and adjacent or against a pair of adjacent hooks 74. This results in the second layer of tiles 90 being centered over the open joints or cracks 110 in the first layer or course of tiles 90 so as to maximize the protection against rain or moisture leaking through the cracks 110 and onto the roof deck 10.

Figure 15:
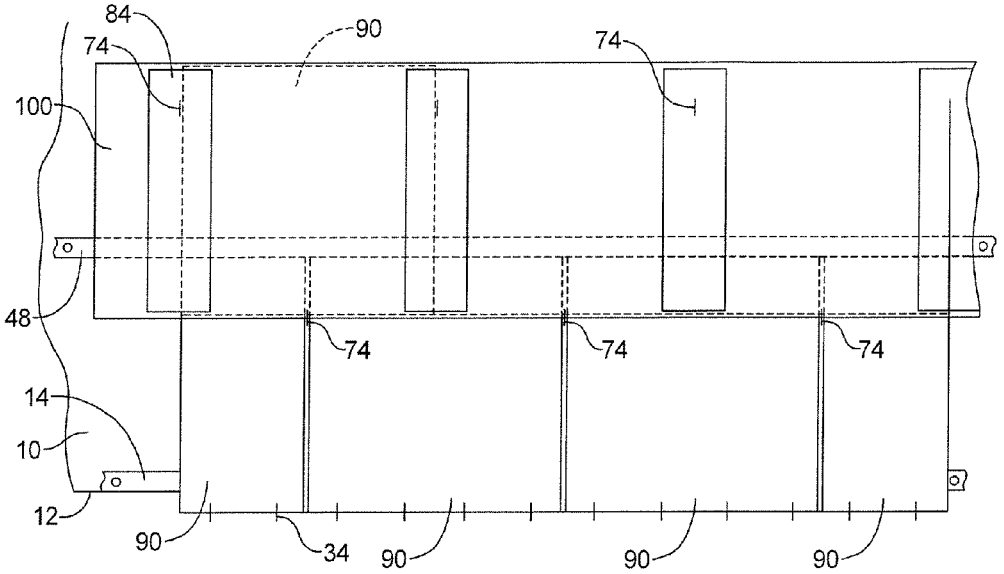
FIG. 15 is a view of FIG. 14 with a second weather shield installed within the hooks of the underlying mounting strip and showing in phantom the positioning of a first tile in a second course tiles and aligned over the second or upper weather shield.

Once the first two layers of tiles are installed along the eave 12 to form the first tile row, a weather shield 100 as described above is layered over the mounting strip 48 and the top portion (such as the top three inches) of the first double layered row of tiles 90 as shown in FIG. 15. The hooks 74 on the shield strips 84 are aligned over the respective centers or the middle of the tiles on the top layer of tiles 90, and the bottom edge of the weather shield 100 is inserted into the hooks 74 on the mounting strip 48 as further shown in FIG. 15. This positioning of the weather shield also aligns the hooks 74 over the underlying cracks or joints 110 in the first tile layer.

At this point, an upper row of slate tiles 90 is installed over the weather shield 100 by insertion into the hooks 74 on the mounting strip 48 and between adjacent pairs of hooks 74 on the weather shield 100, similar to that described above with respect to the second embodiment (see FIG. 13).

Only one tile 90 in this upper or third layer of tiles 90 is shown in phantom in FIG. 15 for purposes of clarity. As in the second embodiment of FIGS. 12 and 13, once the first weather shield 100 is installed and a second row of tiles 90 is layered over it and between adjacent hooks 74, a second weather shield 100 is layered over the top portion of the first installed weather shield 100 and over the tops of the tiles laying over the first weather shield 100.

The second or upper weather shield 100 is inserted into the hooks 74 on the first or lower weather shield 100, with the hooks 74 on the second or upper weather shield 100 aligned directly in line over the hooks 74 on the mounting strip 48 to provide a staggered symmetrical pattern of hooks 74. This results in the hooks 74 on the second weather shield 100 being positioned over the middle of each underlying tile 90 in the second row of tiles.

Tiles 90 are then installed over the second or upper weather shield 100 as described above with respect to the previous embodiment. This installation sequence is repeated until the tiles cover the roof deck 10 up to its ridge or top. It should be noted that the first row or course of tiles along the eave 12 receives the weight of two completely overlapped full size tiles as well as a portion of the weight of the tiles in the upper or second row of tiles. This weight provides increased resistance against wind damage.

The next embodiment enjoys all of the advantages of the previous embodiment while further simplifying tile installation and eliminating the need for mounting strip 48. This is achieved with the use of a modified drip edge 14 having a top strip 24 with an elongated height which exceeds the height of the eave tiles which overlie it. That is, as seen in FIG. 16, the top strip 24 on the drip edge assembly 14 can be 13 inches or more when installing tiles 90 with a height of 12 inches.

Figure 16:
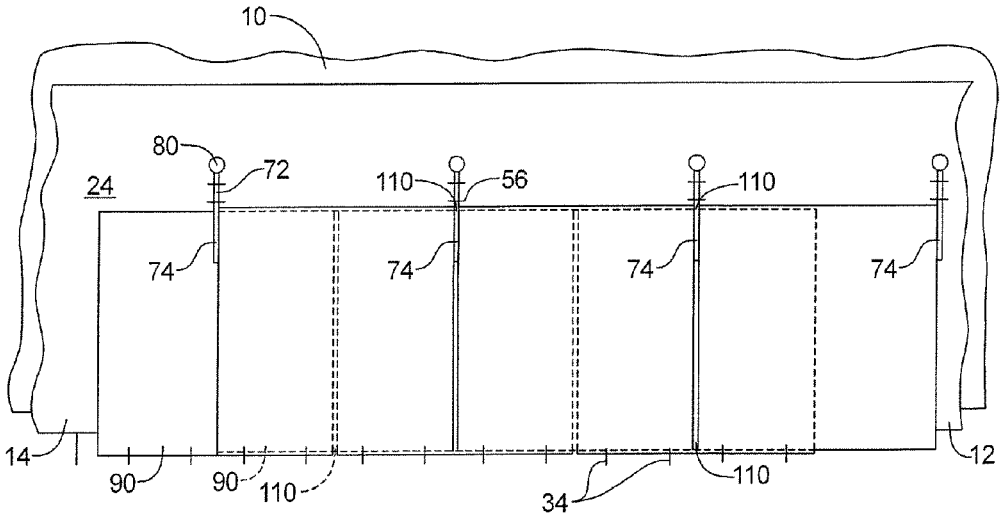
FIG. 16 is a top plan view of a fourth embodiment of this disclosure showing a modified drip edge assembly facilitating tile installation.

The modified or vertically extended drip edge 14 is provided with a first series of hooks 34 along the bottom edge portion of the top strip 24 as described above, but also provided with a second series of upper hooks 74 as shown in FIG. 16. This second series of hooks 74 is fastened to the upper portion of the vertically elongated drip edge 14 with fasteners such as staples, rivets and/or nails 80.

The lateral spacing between the hooks 74 is the same as described above, allowing for the placement of a row of tiles 90 closely between each adjacent pair of hooks 74, as further shown in FIG. 16. That is, the spacing of hooks 74 approximately equals the side to side lateral dimension of the tiles 90.

Figure 18:
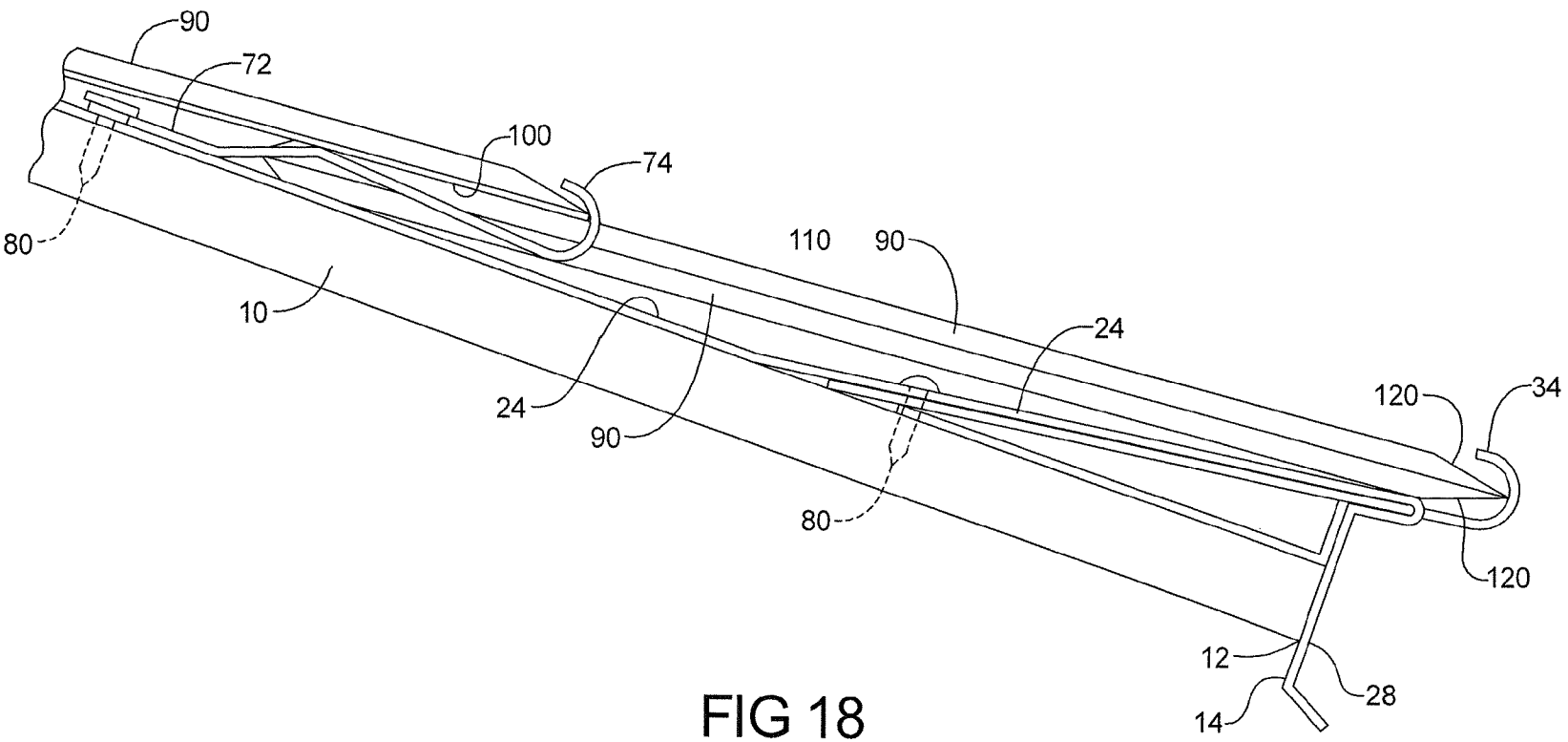
FIG. 18 is a partial side view of the first two courses of tiles of FIG. 17 taken along a joint between two tiles in the upper layer of the first tile row.

Once the modified or enlarged drip edge assembly 14 is fastened over the eave 12 of roof deck 10 as described previously, a first layer of full size (e.g. 12"×12") tiles is installed over the eave 12 by sliding the upper edge of each tile 90 under the hook 74 and shank 72 of each tile fastener on the drip edge 14 as shown in FIGS. 16 and 18. As an option, the hook 74 may be fastened to the drip edge with a pivotal or rotational connection, such as with a loosely crimped rivet. That is, the mounting portion of the hook 74 may be formed as an eyelet or loop, and a rivet or other fastener can be inserted through the eyelet or loop and crimped with a loose frictional engagement allowing for frictional pivotal movement of the hook 74 around the fastener. This allows the hook 74 to be pivoted upwardly along the pitch of the roof and thereby allowing free unobstructed placement of the upper tile in the drip edge hooks 34. Once a first layer tile is installed in the drip edge hooks 34 and laid flat over the top strip 24, the upper hook 74 can be swung or pivoted downwardly over the middle of this underlying tile in the first layer.

The tile fastener shown in FIG. 18 can act as a cantilevered spring arm to provide a downward biasing force on the top underlying portion of the first tile layer. That is, the shank 72 and/or the bottom of the hook 74 of each tile fastener can be dimensioned to engage the top of a tile 90 with an interference fit causing the shank 72 and hook 74 to bend upwardly away from the roof deck 10 so as to apply a downward spring force on tile 90 thereby pressing tile 90 against the top strip 24 holding tile 90 in place on the roof deck 10. As shown in FIG. 18, a hook 74 on the drip edge assembly 14 is biased against the first layer of tiles 10 and located in a channel or crack 110 between a pair of adjacent tiles in the second layer.

Figure 17:
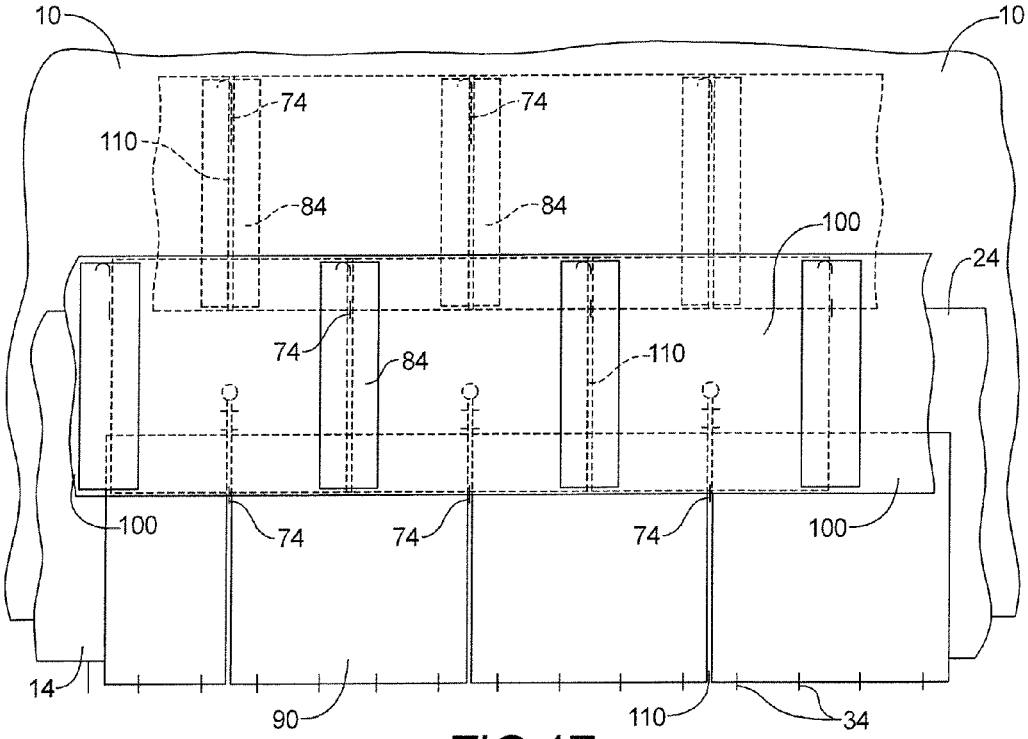
FIG. 17 is a view of FIG. 16 with a first weather shield installed over the drip edge and a second weather shield shown in phantom.

Once the top portion of the tile is secured under the shank and hook of a tile fastener, it is pulled slightly downwardly so that the bottom edge of the tile seats securely in one or more hooks 34 on the drip edge assembly 14, as further shown in FIGS. 16, 17 and 18. Next, a second layer of full size tiles 90, the same size as the first layer of tiles 90, is installed between the hooks 74 on the upper portion of the drip edge 14. This layer of tiles 90 is shown in phantom in FIG. 16 and in solid and dashed lines in FIG. 17.

The beveled edges of these first two layers of tiles can be arranged with their bottom chiseled or beveled edges 120 as shown in FIG. 18 to provide a more eye catching and pleasing appearance. The tiles 90 in the first two layers of the bottom row or course are arranged in a staggered symmetrical overlapping pattern as shown in FIGS. 16 and 17 and as described in the previous embodiment. This centers the hooks 74 over the center of the tiles in the lower layer and in the channels or cracks 110 formed between the side edges of tiles 90 in the second or upper layer of the first row or course of eave tiles.

Next, a weather shield 100 as described above is placed over the top portion of the upper layer of tiles 90 and inserted into the hooks 74 on the drip edge assembly 14 as shown in FIGS. 17 and 18. The hooks 74 on the weather shield 100 are centered over the middle of the tiles 90 in the upper layer of tiles on the first row of tiles, as further shown in FIG. 17. This provides for the symmetrically staggered or offset tile pattern described in each of the embodiments described herein.

With the weather shield 100 installed in place, a second row of tiles 90 is installed by centering each tile in a respective hook 74 on the drip edge assembly 14 and between a pair of hooks 74 on the weather shield 100. This second row of tiles 90 is shown in phantom in FIG. 17. Once the second row of tiles is installed, a second weather shield 100 is inserted into the hooks 74 on the lower or first weather shield assembly, as shown in phantom in FIG. 17.

The hooks 74 on the second weather shield 100 are positioned in line i.e. directly over the hooks 74 on the drip edge assembly 14 and midway between the hooks 74 on the first weather shield 100 to provide the symmetrically staggered tile pattern shown in FIG. 17.

At this point, additional rows of tiles 90 and layers of weather shield 100 are installed upwardly along the pitch of the sloping roof deck 10 until the ridge of the roof is reached where a ridge cap or cover is installed.

It will be appreciated by those skilled in the art that the above weather shielding system for slate and tile roofs is merely representative of the many possible embodiments of the disclosure and that the scope of the disclosure should not be limited thereto.

What is claimed:

1. A weather shield assembly for tile roofs, comprising:

a sheet of water resistant roofing material constructed to extend over a roof;

a water resistant shield strip disposed above said sheet of water resistant roofing material; and a tile fastener comprising a mounting portion fixed in a first location above both said sheet of water resistant roofing material and said water resistant shield strip and a shank portion extending from said mounting portion into a hook portion, said shank portion having a wing portion extending laterally below each side of said hook portion between said sheet of water resistant roofing material and said water resistant shield strip.

2. The weather shield assembly of claim 1, wherein said tile fastener is fixed to said sheet of water resistant roofing material and said water resistant shield strip with a staple.

3. A preassembled weather shield assembly for tile roofs, comprising;

a sheet of water resistant roofing material constructed to overlie a roof deck;

a plurality of water resistant shield strips coupled to said sheet of water resistant roofing material;

a plurality of tile fasteners respectively coupled to said plurality water resistant shield strips and to said sheet of water resistant roofing material; and each of said plurality of tile fasteners comprising a first fastener portion extending through a first portion of one of said water resistant shield strips and a second fastener portion extending through a second portion of said one of said water resistant shield strips wherein said first fastener portion comprises a shank portion extending on top of said sheet of water resistant roofing material and extending underneath said one of said water resistant shield strips between said first and second portions of said one of said weather resistant shield strips.

4. The preassembled weather shield assembly of claim 3, wherein one of said plurality of tile fasteners comprises laterally-extending wing portions extending under one of said plurality of shield strips.

5. The preassembled weather shield assembly of claim 3, wherein said second fastener portion comprises a hook portion extending through and projecting above one of said plurality of water resistant shield strips.

6. The preassembled weather shield assembly of claim 3, wherein each of said plurality of shield strips is formed with a slit or slot and wherein each of said plurality of fasteners respectively extends through said slit or slot.

7. The preassembled weather shield assembly of claim 3, wherein each of said plurality of shield strips is formed with a hole and wherein each of said plurality fasteners extends through said hole.

* * * * *